United States Patent [19]

Shuji

[11] 4,044,465

[45] Aug. 30, 1977

[54] CUTTING APPARATUS FOR A RUSTY NUT

[76] Inventor: Hashimoto Shuji, No. 224-1 Notame-Oaza,, Minami, Fukuoka, Japan

[21] Appl. No.: 704,053

[22] Filed: July 9, 1976

[30] Foreign Application Priority Data

Feb. 17, 1976 Japan ..... 51-16712[U]

[51] Int. Cl.[2] ..... B26B 17/00

[52] U.S. Cl. ..... 30/180

[58] Field of Search ..... 30/180, 187, 228, 188, 30/177

[56] References Cited

U.S. PATENT DOCUMENTS

| | | | |
|---|---|---|---|
| 1,592,017 | 7/1926 | Van Campen | 30/180 |
| 2,696,042 | 12/1954 | Wallace | 30/180 |
| 3,670,411 | 6/1972 | Peters | 30/180 |

FOREIGN PATENT DOCUMENTS

| | | | |
|---|---|---|---|
| 1,223,942 | 2/1960 | France | 30/180 |
| 2,310,098 | 9/1974 | Germany | 30/187 |

*Primary Examiner*—Jimmy C. Peters

*Attorney, Agent, or Firm*—C. Bruce Hamburg

[57] ABSTRACT

A cutting apparatus for a rusty nut comprising two blades fixed on top inside portions of arms, two arms coupled by a link plate and axes, gears fixed on the axes to move the arms simultaneously, pressure mechanism to move the arms and reversal mechanism to reverse the arms.

2 Claims, 5 Drawing Figures

CUTTING APPARATUS FOR A RUSTY NUT

Figure 1:
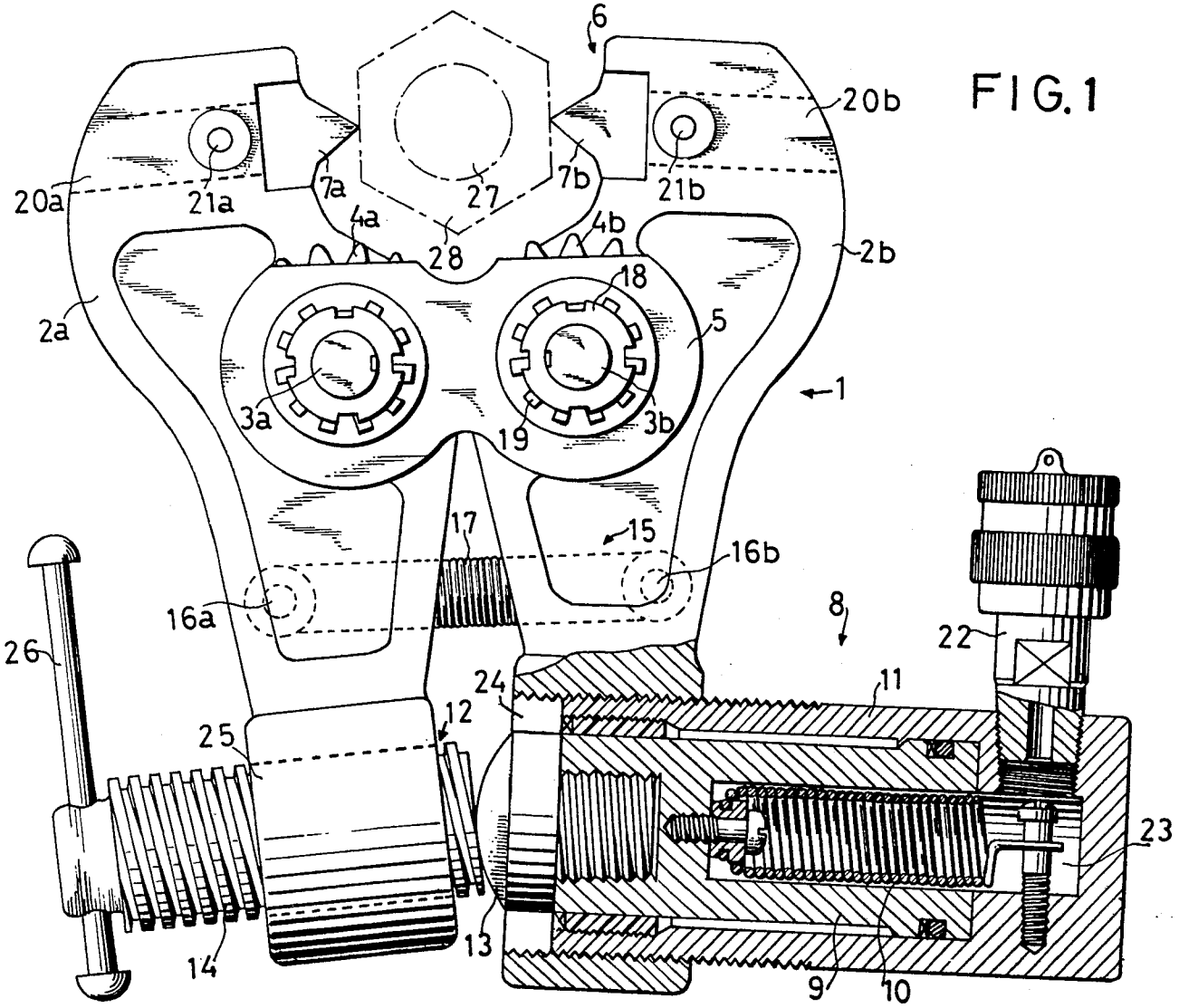

This invention relates to a cutting apparatus for a rusty nut which cannot be removed from a bolt by a common tool such as a spanner. As a conventional apparatus to remove a rusty nut, for example, there is one having a fixed blade and a movable blade which are fixed in counter positions of a square frame, and a pressure mechanism to push out said movable blade toward the fixed blade, as described in a Japanese Utility Model Publication No. 39-27,065. As another example, the present inventor's one is known, as described in a Japanese Utility Model Publication No. 49-22,064. This has a movable blade placed in a nut inserting opening similar to the external form of a nut, and said movable blade is pressed out by a pressure mechanism to the nut. In a Japanese Patent Publication No. 49-31,514, a mechanism the same as the one of the above mentioned Publication No. 39-27,065 is described. But in the above conventional cutting apparatuses for a rusty nut, there are some disadvantages, namely said apparatuses are too heavy and big since a big power pressure mechanism is necessary to a high level of cutting power to the movable blade because the movable blade is directly connected with the pressure mechanism as an oil pressure cylinder. Moreover, in a case a nut is fixed in narrow space between the periphery of the nut and a body such as a tank on which the nut is fixed, or between the upper face of the nut and another body, said nuts cannot be cut off. In the case of a conventional cutting apparatus, several kinds of nut in different size cannot be cut off by the same type of a conventional cutting apparatus.

The present invention has been created to overcome the above disadvantages, and the first object of the present invention is to disclose provide a cutting apparatus for a rusty nut designed to have a construction in which a pressure mechanism formed on an end portion of an arm pushes on a receiving member formed on an end portion of another arm. This is designed to use a principle of the lever, provide a high level of cutting power as compared with a low level of power generated by a pressure mechanism, and make the apparatus of small size.

The second object of the present invention is to provide a cutting apparatus for a rusty nut designed to have a construction to enable it to cut off and remove a nut which is fixed on a bolt in a narrow space between the periphery or the upper face of a nut and a body on which the nut is fixed.

The third object of the present invention is to provide a cutting apparatus for a rusty nut designed to have a construction which enables the changing of the distance between a blade and another one, for the efficient cutting off of nuts of several different diameters by one type of a cutting apparatus.

The fourth object of the present invention is to provide a cutting apparatus for a rusty nut which cuts off a nut without a hitch by all members included in the cutting apparatus when said nut is fixed on a plane surface such as an iron plate.

The fifth object of the present invention is to provide a cutting apparatus for a rusty nut designed to have a construction in which two blades fixed in counter places on top portions of arms can be moved in directions such that both blades come near each simultaneously, in order to cut off a nut reliably and in only a short time.

Now the present invention, by means of which the objects as set forth above are attained, will be described in connection with the accompanying drawings.

Figure 2:
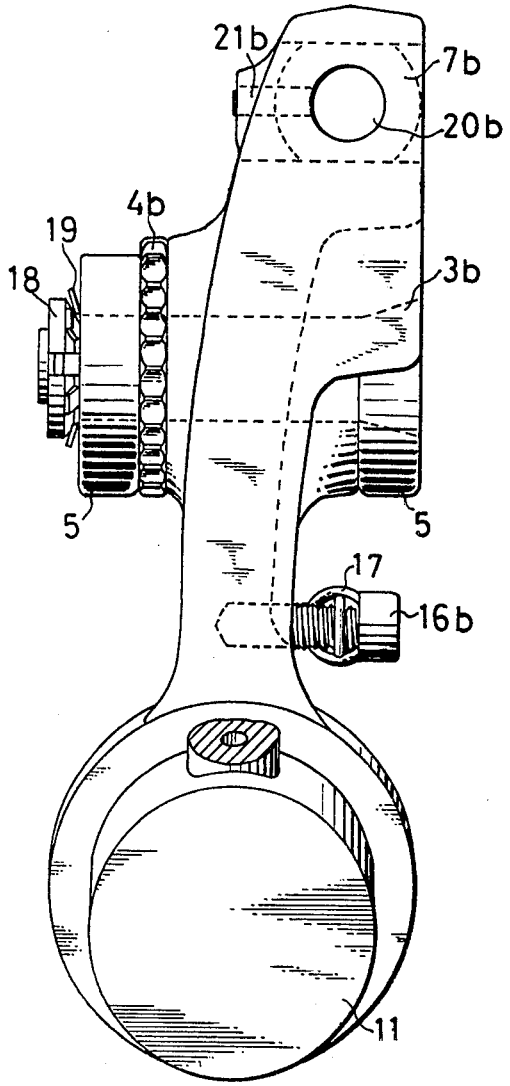
Figure 5:
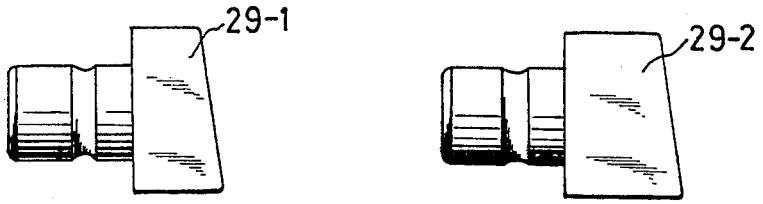
Figure 3:
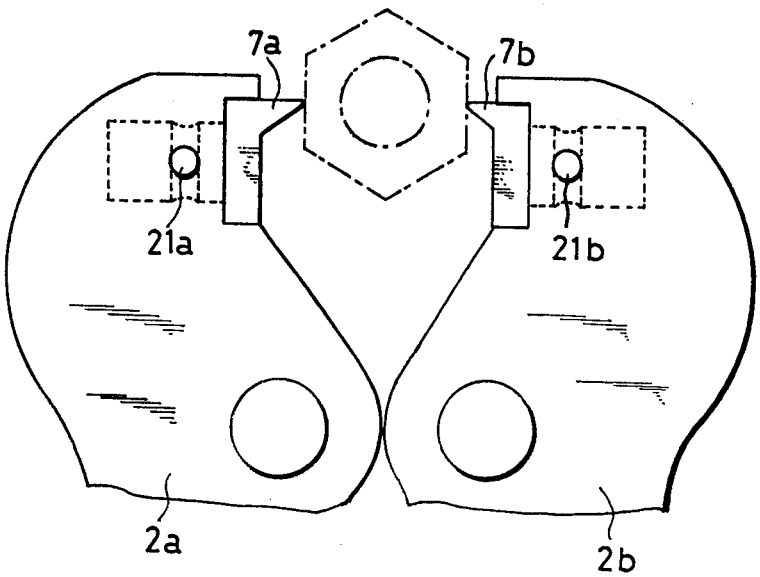
Figure 4:
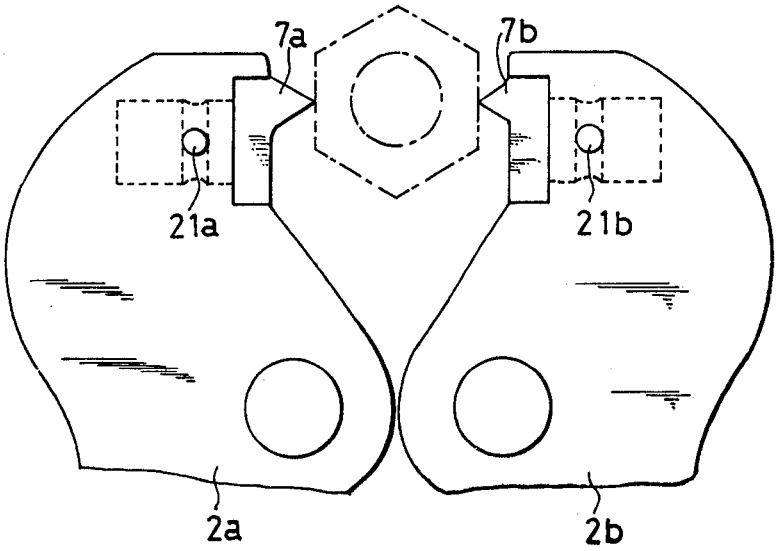

FIG. 1 is a plan, partly in section, showing an embodiment of the present invention, FIG. 2 is a right side view of the above, FIGS. 3 and 4 are plan views showing blades in other embodiments, FIG. 5 is a plan view showing a set of attachments to be used as part of the receiving member.

EMBODIMENT 1

In FIGS. 1 and 2, numeral 1 represents a body of a cutting apparatus comprising two arms 2*a*, 2*b* placed at counter positions. Said arms 2*a*, 2*b* are coupled by axes 3*a*, 3*b* and gears 4*a*, 4*b* which are rotatably mounted on a link plate 5. The top portions of the two arms come near to each other as the bottom portions of the arms move away from each other. If of the axes 3*a*, 3*b* are placed near the top of the arms, greater leverage is provided. The position of the axes should be decided considering that a locus of the top of the arms in the cutting operation must be in straight line.

Numeral 6 represents a cutting mechanism fixed on the top portion of the body 1, said mechanism 6 comprising two movable blades 7*a*, 7*b* placed in counter positions on the insides of the top portion of the arms 2*a*, 2*b*. Numeral 8 represents a pressure mechanism fixed on an end portion of one of the arms 2*b*, said mechanism 8 comprising a piston rod 9 moved by oil pressure toward the end portion of the other arm 2*a*, and a cylinder 11 in which a spring 10 is placed to return the piston rod 9. Numeral 12 represents a receiving member fixed on the end portion of the arm 2*a*, said member 12 comprising a movable member such as a screw 14 which is contacted by a top member 13 of the piston rod 9. Numeral 15 represents a return mechanism to bring the end portions of the two arms back to proximity, said mechanism 15 comprising a spring 17 fixed on the arms 2*a*, 2*b* by screws 16*a* and 16*b* in middle positions of the arms 2*a*, 2*b*. And, numeral 18 represents a lock nut, 19 a lock washer, 20*a* and 20*b* hollowed parts in the end of the arms 2*a*, 2*b* to insert legs of the cutting blades 7*a*, 7*b* thereinto, 21*a*, 21*b* screws to fix legs of the cutting blades, 22 a coupler to join a pipe running from a oil pressure pump not shown in FIG. 1, 23 an oil chamber, 24 threads machined inside of the end of the arm 2*b* to fix the oil cylinder 11, 25 threads machined inside of the end of the arm 2*a* to permit adjustment of the screw 14, 26 a handle to revolve the screw 14.

Next, there will be described how to operate the cutting apparatus of the present invention having the above mentioned mechanism. At first, distance between the blades 7*a* and 7*b* should be decided to closely fit the rusty nut therein, the distance being adjusted by operating the handle 26. Namely, according to the operation of the handle 26, the movable member 14 is moved forwardly or backwardly, and the end portions of the arms 2*a*, 2*b* approach or separate from each other. Then, the oil chamber 23 is filled with hydraulic fluid to extend the piston rod 9, and the top member 13 of the piston rod 9 pushes the receiving member 12 outwardly. As the piston rod 9 extends, the distance between the ends of the arms 2*a* and 2*b* increases at the tops of the arms 2*a*, 2*b* are rotated inward. When the tops of the arms come near, the cutting blades 7*a*, 7*b* begin to cut into the nut 28 until said nut 28 is cut off. In this case, because the combined gears 4*a*, 4*b* fixed on the axes 3*a*, 3b are rotated according to the revolution of the arms 2a, 2b, each of the arms 2a, 2b is rotated simultaneously, and two cutting blades cut into the nut 28 simultaneously.

After the nut is cut off, hydraulic fluid is removed from the oil chamber by operation of a swiching valve, the piston rod 9 is returned to the first position by the spring 10, at the same time, the arms 2a, 2b are returned to the first position by the spring 17, during which the receiving member 12 contacts continuously with the top member 13 of the piston rod 9.

Moreover, if it is desired to cut a nut of a different size, the distance between the cutting blades 7a and 7b should be changed by operation of the handle 26 as described above. In this embodiment, the direction of edges of the blades is the same as direction of the arms. In case a nut is fixed in a narrow place such a hole, the direction of the edges of the cutting blades 7a, 7b should be rotated 90° when they are fixed in the hollowed parts 20a, 20b.

Parts of the construction of the above mentioned embodiment may be changed as described in the following embodiments.

EMBODIMENT 2

The arms may be coupled by an axis only. In this case, projections should be formed inside of each of the arms to fix the axis thereon. Since gears as described in embodiment 1 are not provided in this embodiment, the two arms do not move simultaneously.

EMBODIMENT 3

Two axes may be provided as in embodiment 1, but with the gears 4a, 4b being omitted. In this case, the same as in embodiment 2, it may occur that simultaneous rotation of the arms cannot be obtained according to the circumstances.

EMBODIMENT 4

In an apparatus as described in any of embodiments 1 through 3, it is possible to exchange one of the blades for a nut receiving member. Namely, a blade is fixed on the top inside portion of the arm to which the receiving member is fixed in the above embodiments, the nut receiving member has the outer shape of a nut, and the latter member is fixed on the top inside portion of the arm to which the pressure mechanism is fixed. In this embodiment, only one side of the nut is cut off.

EMBODIMENTS 5

The cutting blades shown in FIGS. 3 and 4 can be used for the blades described in embodiment 1. In these embodiments, since the position of the edges of the blades is nearer the top ends of the arms, it is possible to provide a shorter distance between tops of the arms 2a and 2b than the distance in embodiment 1, when the same size of the nut is to be cut off.

EMBODIMENT 6

Regarding a pressure mechanism, a conventional cylinder of oil or air can be used as the oil pressure cylinder described in embodiment 1. Moreover, as the oil pressure pump connected to the cylinder shown in FIG. 1, an electric motor or hand operated pump can be used. When the pressure mechanism 8 especially the cylinder 11, can be moved easily inside of the internally threaded portion 24, the distance between the cutting blades 7a and 7b can be changed by moving the cylinder, even if the receiving member 14 is not provided.

EMBODIMENT 7

As a movable member which is used to receive the top member 13 of the piston rod 9, a rod member having no threads can be used. In this case, said rod member should be fixed to the bored portion of the arm 2a by a member such as a small bolt.

Moreover, instead of a movable member, attachments 29-1, 29-2 of different lengths as shown in FIG. 5 can be used. In this case, a slit to insert the leg of the attachment is machined inside of the end portion of the arm 2a.

If the movable member 14 or the attachments 29-1, 29-2 are not used for the receiving member 12, the inside end of the arm 2a is used to receive the top member 13 of the piston rod 9.

EMBODIMENT 8

For a reversal mechanism, the spring 17 can be fixed between the ends of the arms 2a and 2b. If the spring is fixed or near the blades, a different kind of spring which acts to widen the distance between the arms 2a, 2b should be used.

OTHER EMBODIMENTS

It is desirable that a bottom face near the blades and axes be planar, as shown in FIG. 2, and all mechanisms, namely the arms 2a, 2b, link plate 5, pressure mechanism 8, receiving member 12 and reversal mechanism, be arranged over the bottom face. In this arrangement, it is possible to easily cut off and remove a nut without interference by structure of the cutting apparatus, even if said nut is fixed on a wide plane surface.

Other embodiments of the present invention are included in all arrangements which become clear from the above description and the hereto appended claims.

As described above, a cutting apparatus of the present invention has the following useful advantages. Namely, a high level of cutting power can be obtained by using the principle of a lever as compared with a low level of power generated by a pressure mechanism of small size. A cutting apparatus can be designed in small size and right weight. By means of this cutting apparatus, a rusty nut fixed on a bolt in a narrow space between the periphery or the upper face of a nut and another body can be cut off and removed easily.

Moreover, because this cutting apparatus provides a construction to change the distance between a pair of blades, several kinds of nuts having diameters different can be cut off efficiently by one type of the cutting apparatus. And because two arms are coupled by the link plate and gears, and two blades can be moved simultaneously, this cutting apparatus is able to reliably cut off a nut in a short time without running the bolt.

What is claimed is:

1. Apparatus for cutting a rusty nut comprising two arms, two blades, a respective one of the blades being mounted near one end of each of the arms in opposition to the other blade on the other arm, a hydraulic cylinder and piston assembly mounted at the other end of one of the arms, the cylinder being connected to said other end of said one arm, adjustable means connected to the other end of the other arm and providing a surface for being contacted by the free end of the piston, the hydraulic assembly being so oriented that actuation of the piston extends the piston toward the other arm and into contact with the adjustable means, the adjustable means including means for adjusting said surface toward or away from the free end of the piston, a respective axis connected to each of the arms at a point between the ends thereof, each of the arms being pivotable about its respective axis, a plate connected to both axes and thereby linking the arms together, a respective gear rotatably mounted on each of the axes, the gears being in mutual engagement so that the arms move simultaneously inwardly or outwardly and spring means for urging the arms away from each other.

2. Apparatus according to claim 1, in which the adjustable means comprises a threaded bore formed through the other end of the other arms and a threaded member received in the threaded bore and adjustable by being advanced or retracted in the bore by being rotated.

* * * * *

UNITED STATES PATENT AND TRADEMARK OFFICE

CERTIFICATE OF CORRECTION

PATENT NO. : 4,044,465

DATED : August 30, 1977

INVENTOR(S) : Hashimoto SHUJI

It is certified that error appears in the above-identified patent and that said Letters Patent are hereby corrected as shown below:

Column 1, line 27, after "fixed in" insert --a--;
line 36, delete "disclose";
line 40, change "a" to --the--;
line 66, after "each" insert --other--.

Column 2, line 4, after "plan" insert --view--;
line 19, delete "of";
line 21, change "The" to --But the--;
line 64, change "at" to --and--.

Column 3, line 17, after "such" insert --as--;
line 45, after "fixed" insert --as--;
line 66, change "8" to --8,--.

Column 4, line 23, after "fixed" insert --on--;
line 51, "different" should come before --diameters--;
line 56, change "running" to --ruining--.

Column 6, line 5, change "arms" to --arm--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*